US009141040B2

(12) United States Patent
Kurita et al.

(10) Patent No.: US 9,141,040 B2
(45) Date of Patent: Sep. 22, 2015

(54) IMAGE FORMING APPARATUS AND FIXING DEVICE

(75) Inventors: Atsumi Kurita, Kanagawa (JP); Yoshiya Imoto, Kanagawa (JP); Mitsuhiro Matsumoto, Kanagawa (JP); Shigeki Washino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 959 days.

(21) Appl. No.: 13/189,027

(22) Filed: Jul. 22, 2011

(65) Prior Publication Data

US 2012/0141174 A1 Jun. 7, 2012

(30) Foreign Application Priority Data

Dec. 1, 2010 (JP) ..... 2010-268683

(51) Int. Cl.
*G03G 15/20* (2006.01)
*G03G 15/16* (2006.01)

(52) U.S. Cl.
CPC ..... *G03G 15/161* (2013.01); *G03G 15/2025* (2013.01); *G03G 15/2028* (2013.01); *G03G 2215/20* (2013.01)

(58) Field of Classification Search
CPC ..... G03G 15/2064; G03G 15/2067
USPC ..... 399/67, 328, 329
See application file for complete search history.

(56) References Cited

U.S. PATENT DOCUMENTS

2010/0172677 A1 7/2010 Hosokawa et al.
2010/0226700 A1* 9/2010 Yamada et al. ..... 399/329
2011/0188908 A1* 8/2011 Ishida et al. ..... 399/330

FOREIGN PATENT DOCUMENTS

JP 2003337489 A * 11/2003
JP 2007163692 A * 6/2007
JP 2008-139724 A 6/2008
JP 2009-069565 A 4/2009
JP 2010-032973 A 2/2010

OTHER PUBLICATIONS

Fuma (JP 2003-337489 A), Nov. 2003, JPO Computer Translation.*
Communication dated May 5, 2015 from the State Intellectual Property Office of the P.R.C. in counterpart application No. 201110268322.0.

* cited by examiner

*Primary Examiner* — Erika J Villaluna
(74) *Attorney, Agent, or Firm* — Sughrue Mion, PLLC

(57) ABSTRACT

An image forming apparatus includes an image forming unit that forms an image on a recording material; an endless belt member; a pressure member that applies pressure to the belt member; a pressing member that presses the belt member from an inner side of the belt member towards the pressure member; and an adjusting section that adjusts a position of an end portion of a nip part at a downstream side in a movement direction of the recording material and a position of a curved portion of the belt member by moving or deforming the pressing member, the nip part being formed by the belt member and the pressure member, the curved portion of the belt member being formed by an end portion of the pressing member at a downstream side in the movement direction of the recording material.

7 Claims, 12 Drawing Sheets

IMAGE FORMING APPARATUS AND FIXING DEVICE

CROSS-REFERENCE TO RELATED APPLICATIONS

This application is based on and claims priority under 35 USC 119 from Japanese Patent Application No. 2010-268683 filed Dec. 1, 2010.

BACKGROUND

(i) Technical Field

The present invention relates to an image forming apparatus and a fixing device.

SUMMARY

According to an aspect of the invention, there is provided an image forming apparatus including an image forming unit that forms an image on a recording material; an endless belt member that is rotatably provided and that has a curved portion; a pressure member that is provided at an outer peripheral surface of the belt member so as to contact the outer peripheral surface of the belt member, the pressure member applying pressure to the belt member; a pressing member that presses the belt member from an inner side of the belt member towards the pressure member; and an adjusting section that adjusts a position of an end portion of a nip part at a downstream side in a movement direction of the recording material and a position of the curved portion of the belt member by moving or deforming the pressing member, the nip part being formed by the belt member and the pressure member, the curved portion of the belt member being formed by an end portion of the pressing member at a downstream side in the movement direction of the recording material.

BRIEF DESCRIPTION OF THE DRAWINGS

Exemplary embodiments of the present invention will be described in detail based on the following figures, wherein.

DETAILED DESCRIPTION

Exemplary embodiments of the present invention will hereunder be described in detail with reference to the attached drawings.

First Exemplary Embodiment

Figure 1:
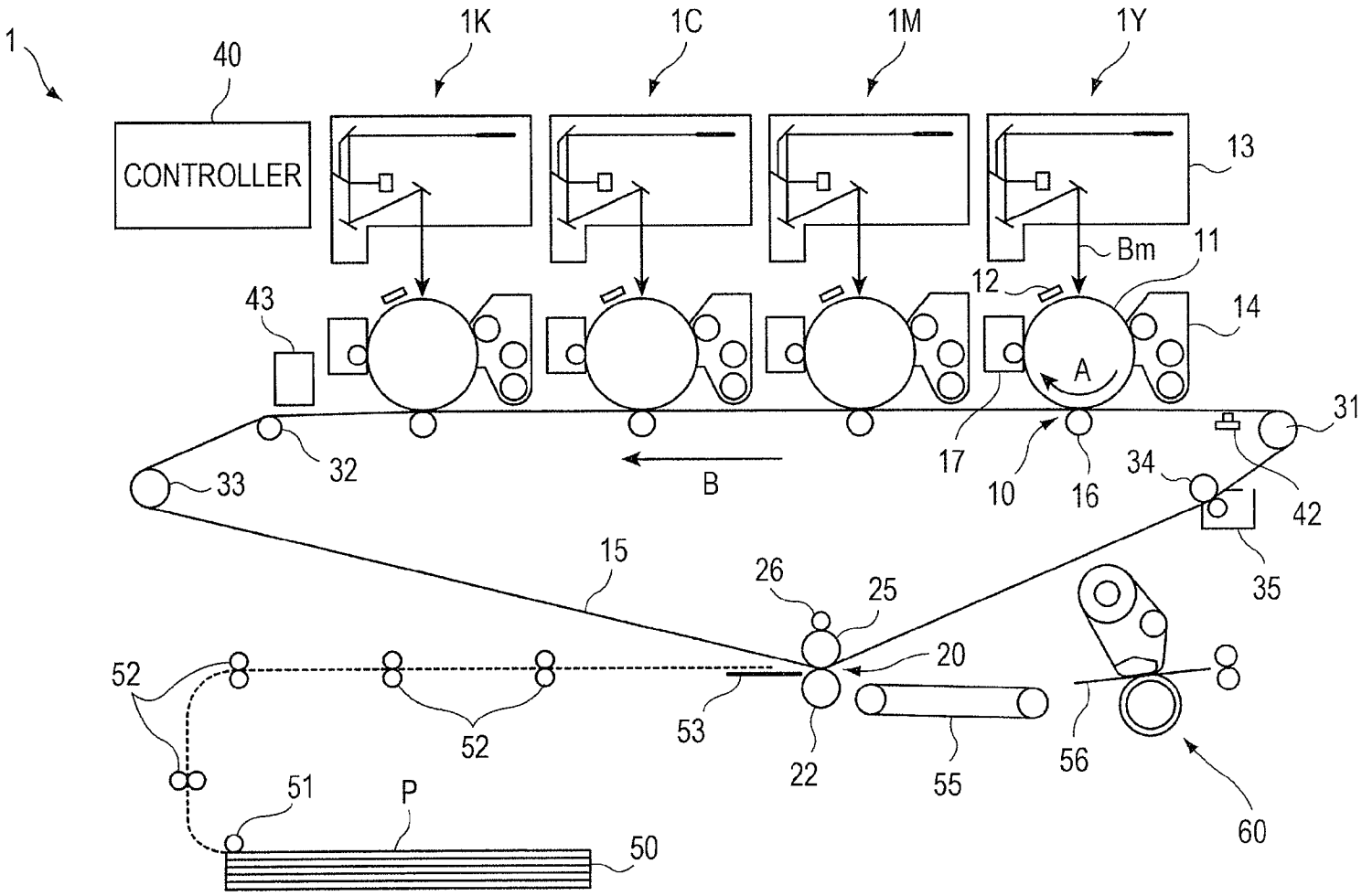
FIG. 1 shows an image forming apparatus to which an exemplary embodiment is applied.

FIG. 1 shows an image forming apparatus 1 to which an exemplary embodiment is applied.

The image forming apparatus 1 shown in FIG. 1 is an intermediate-transfer image forming apparatus 1 that is generally called a tandem image forming apparatus. The image forming apparatus 1 includes image forming units 1Y, 1M, 1C, and 1K, a first transfer unit 10, a second transfer unit 20, and a fixing device 60. The image forming units 1Y, 1M, 1C, and 1K form toner images of respective color components by electrophotography. The first transfer unit 10 successively transfers the toner images of the respective color components formed by the respective image forming units 1Y, 1M, 1C, and 1K to an intermediate transfer belt 15 by first transfer operations. The second transfer unit 20 transfers all superposed toner images transferred to the intermediate transfer belt 15 together to a sheet P (recording material) by second transfer operations. The fixing device 60 fixes the images transferred by the second transfer operations to the sheet P. The image forming apparatus 1 also includes a controller 40 that controls the fixing device 60 and each section, such as an adjusting mechanism (described later), of the fixing device 60.

In the exemplary embodiment, each of the image forming units 1Y, 1M, 1C, and 1K (serving as exemplary image forming sections) has electrophotographic devices, such as a charger 12, a laser exposure unit 13 (illustrated exposure beam is indicated by Bm), a developing unit 14, a first transfer roller 16, and a drum cleaner 17, successively disposed around a photoconductor drum 11 that rotates in the direction of arrow A. Each charger 12 charges its corresponding photoconductor drum 11. Each laser exposure unit 13 forms an electrostatic latent image on its corresponding photoconductor drum 11. Each developing unit 14 contains toner of its corresponding color component, and makes visible the electrostatic latent image on its corresponding photoconductor drum 11 with the toner. At each first transfer unit 10, each first transfer roller 16 transfers to the intermediate transfer belt 15 the toner image of its corresponding color component formed on the corresponding photoconductor drum 11. Each drum cleaner 17 removes residual toner on its corresponding photoconductor drum 11. The image forming units 1Y, 1M, 1C, and 1K are such that the image forming unit 1Y corresponding to yellow (Y), the image forming unit 1M corresponding to magenta (M), the image forming unit 1C corresponding to cyan (C), and the image forming unit 1K corresponding to black (K) are linearly disposed in that order from an upstream side of the intermediate transfer belt 15.

The intermediate transfer belt 15, which is an intermediate transfer body, is a film-like endless belt in which a suitable amount of antistatic agent, such as carbon black, is contained in resin, such as polyimide or polyamide. The intermediate transfer belt 15 is formed so that its volume resistivity is in the range of from $10^6$ to $10^{14}$ Ωcm, and its thickness is, for example, on the order of 0.1 mm. The intermediate transfer belt 15 is circulated and driven at a predetermined velocity in the direction of arrow B shown in FIG. 1 by various rollers. The various rollers include a driving roller 31, a support roller 32, a tension roller 33, a backup roller 25, and a cleaning backup roller 34. The driving roller 31 rotationally drives the intermediate transfer belt 15 by being driven by a motor (not shown) having excellent constant velocity performance. The support roller 32 supports the intermediate transfer belt 15 and extends linearly along a direction of disposition of the photoconductor drums 11. The tension roller 33 applies tension to the intermediate transfer belt 15 and functions as a correcting roller that prevents meandering of the intermediate transfer belt 15. The backup roller 25 is provided at the second transfer unit 20. The cleaning backup roller 34 is provided at a cleaning unit for scraping off residual toner on the intermediate transfer belt 15.

Each first transfer unit 10 includes the first transfer roller 16 disposed so as to oppose the corresponding photoconductor drum 11 with the intermediate transfer belt 15 being interposed therebetween. Each first transfer roller 16 includes a shaft and a sponge layer serving as an elastic layer that is fixed around the shaft. Each shaft is a cylindrical bar formed of a metal, such as iron or SUS. Each sponge layer is a sponge-like cylindrical roller that is formed of rubber blend of NBR, SBR, and EPDM combined with a conductant agent such as carbon black, and that has a volume resistivity of $10^{7.5}$ to $10^{8.5}$ Ωcm. Each first transfer roller 16 is disposed so as to press-contact the corresponding photoconductor drum 11 with the intermediate transfer belt 15 being interposed therebetween. Each first transfer roller 16 is such that a voltage (first transfer bias) having a polarity that is opposite to a charging polarity of the toner is applied thereto. The charging polarity of the toner is a negative polarity, and will hereunder be assumed as being a negative polarity. This causes the toner images on the respective photoconductor drums 11 to be successively electrostatically attracted to the intermediate transfer belt 15, so that superimposed toner images are formed on the intermediate transfer belt 15.

The second transfer unit 20 includes the backup roller 25 and a second transfer roller 22 disposed at a toner-image-carrying-surface side of the intermediate transfer belt 15. The surface of the backup roller 25 is formed of a tube of rubber blend of EPDM and NBR dispersed with carbon, whereas the interior of the backup roller 25 is formed of EPDM rubber. The backup roller 25 is formed so that its surface resistivity is $10^7$ to $10^{10}$ Ω/sq, and its hardness is, for example, 70° (Asker C). The backup roller 25 is disposed at an inner surface side of the intermediate transfer belt 15, and forms an opposing electrode of the second transfer roller 22. A metallic power supply roller 26 to which second transfer bias is applied is disposed so as to contact the backup roller 25.

The second transfer roller 22 includes a shaft and a sponge layer serving as an elastic layer that is fixed around the shaft. The shaft is a cylindrical bar formed of a metal, such as iron or SUS. The sponge layer is a sponge-like cylindrical roller that is formed of rubber blend of NBR, SBR, and EPDM combined with a conductant agent such as carbon black, and that has a volume resistivity of $10^{7.5}$ to $10^{8.5}$ Ωcm. The second transfer roller 22 is disposed so as to press-contact the backup roller 25 with the intermediate transfer belt 15 being interposed therebetween. The second transfer roller 22 is connected to ground, and the second transfer bias is generated between the second transfer roller 22 and the backup roller 25, so that, by the second transfer operations, the toner images are transferred to a sheet P that is transported to the second transport unit 20.

An intermediate transfer belt cleaner 35 is provided at a side of the intermediate transfer belt 15 that is situated downstream from the second transfer unit 20. The intermediate transfer belt cleaner 35 is capable of contacting and separating from the intermediate transfer belt 15. The intermediate transfer belt cleaner 35 cleans the surface of the intermediate transfer belt 15 by removing residual toner and paper dust on the intermediate transfer belt 15 after the second transfer. A reference sensor (home position sensor) 42 is disposed upstream from the yellow image forming unit 1Y. The reference sensor 42 generates a reference signal serving as a reference for setting an image formation timing at each of the image forming units 1Y, 1M, 10, and 1K. An image density sensor 43 for adjusting image quality is disposed downstream from the black image forming unit 1K. The reference sensor 42 is formed so as to recognize a predetermined mark on the inner side of the intermediate transfer belt 15, and generate the reference signal, so that, on the basis of an instruction from the controller 40 based on the recognition of this reference signal, each of the image forming units 1Y, 1M, 1C, and 1K start forming images.

In the image forming apparatus 1 according to the exemplary embodiment, a sheet transporting system includes a sheet holding unit 50, a pickup roller 51, transport rollers 52, a transport path 53, a transport belt 55, and a fixing entrance guide 56. The sheet holding unit 50 holds sheets P. The pickup roller 51 takes out and transports the sheets P stacked in the sheet holding unit 50 at a predetermined timing. The transport rollers 52 transport the sheets P that are sent out by the pickup roller 51. The transport path 53 allows the sheets P transported by the transport rollers 52 to be sent into the second transfer unit 20. The transfer belt 55 transports towards the fixing device 60 the sheets P that are transported after the second transfer by the second transfer roller 22. The fixing entrance guide 56 guides the sheets P to the fixing device 60.

Next, a basic image formation process of the image forming apparatus 1 according to the exemplary embodiment will be described. In the image forming apparatus 1 shown in FIG. 1, image data that is output from, for example, an image reading device (not shown) or a personal computer (PC) (not shown) is processed by an image processor (not shown), after which the image forming units 1Y, 1M, 1C, and 1K form the images. In the image processor, image processing is performed on input reflectance data. Examples of image processing are shading correction, positional displacement correction, brightness/color space conversion, gamma correction, and various image editings (such as frame erasing, color editing, and movement editing). The image data that has been processed is converted into pieces of color material gradation data corresponding to the four colors, Y, M, C, and K. Then, these pieces of data are output to the laser exposure units 13.

At the laser exposure units 13, in accordance with the pieces of color material gradation data that have been input, the photoconductor drums 11 of the respective image forming units 1Y, 1M, 1C, and 1K are irradiated with the exposure beams Bm emitted from, for example, semiconductor lasers. After charging the surfaces of the photoconductor drums 11 of the respective image forming units 1Y, 1M, 1C, and 1K using the respective chargers, the surfaces of the photoconductor drums 11 are scanned and exposed by the laser exposure units 13, so that electrostatic latent images are formed on the surfaces of the photoconductor drums 11. The formed electrostatic latent images are developed as toner images of the respective colors, Y, M, C, and K, by the respective image forming units 1Y, 1M, 1C, and 1K.

At the first transfer units 10 where the photoconductor drums 11 and the intermediate transfer belt 15 contact each other, the toner images formed on the photoconductor drums 11 of the image forming units 1Y, 1M, 1C, and 1K are transferred to the intermediate transfer belt 15. More specifically, at the first transfer units 10, the respective first transfer rollers 16 apply voltages (first transfer biases) having a polarity that is opposite to the charging polarity (negative polarity) of the toner to a base material of the intermediate transfer belt 15, so that the toner images are successively superimposed upon the surface of the intermediate transfer belt 15, as a result of which the first transfer operations are performed.

After successively transferring the toner images onto the surface of the intermediate transfer belt 15 by the first transfer operations, the intermediate transfer belt 15 is moved, so that the toner images are transported to the second transfer unit 20. When the toner images are transported to the second transfer unit 20, the pickup roller 51 in the sheet transporting system rotates in accordance with a timing in which the toner images are transported to the second transfer unit 20, to supply sheets P from the sheet holding unit 50. The sheets P supplied by the pickup roller 51 are transported by the transport rollers 52, and reach the second transfer unit 20 through the transport path 53. Before the sheets P reach the second transfer unit 20, the sheets P are stopped once, and a registration roller (not shown) is rotated in accordance with a timing in which the intermediate transfer belt 15 holding the toner images moves, so that the positions of the sheets P and the positions of the toner images are adjusted.

At the second transfer unit 20, the second transfer roller 22 is pressed against the backup roller 25 through the intermediate transfer belt 15. At this time, the sheet P that is transported in accordance with the timing is interposed between the intermediate transfer belt 15 and the second transfer roller 22. Here, when the feed roller 26 applies a voltage (second transfer bias) having a polarity that is the same as the charging polarity (negative polarity) of the toner, a transfer electric field is generated between the second transfer roller 22 and the backup roller 25. Then, all unfixed toner images that are held by the intermediate transfer belt 15 are together electrostatically transferred to the sheet P at the second transfer unit 20 where the sheet P is pressed by the second transfer roller 22 and the backup roller 25.

Thereafter, the second transfer roller 22 transports the sheet P to which the toner images are electrostatically transferred as it is while the sheet P is separated from the intermediate transfer belt 15, and is transported to the transport belt 55 provided at a downstream side of the second transfer roller 22 in a sheet transportation direction. At the transport belt 55, the sheet P is transported to the fixing device 60 in accordance with an optimal transport velocity in the fixing device 60. The unfixed toner images on the sheet P that is transported to the fixing device 60 are fixed to the sheet P by heat and pressure at the fixing device 60. The sheet P on which the fixed images are formed is transported to a sheet-discharge stacking unit provided at a discharge unit of the image forming apparatus 1.

After the transfer of the toner images to the sheet P ends, any residual toner remaining on the intermediate transfer belt 15 is transported to the cleaning unit as the intermediate transfer belt 15 rotates, and is removed from the intermediate transfer belt 15 by the cleaning backup roller 34 and the intermediate transfer belt cleaner 35.

Structure of Fixing Device

The fixing device 60 used in the image forming apparatus 1 according to the exemplary embodiment will be described in more detail.

Figure 2:
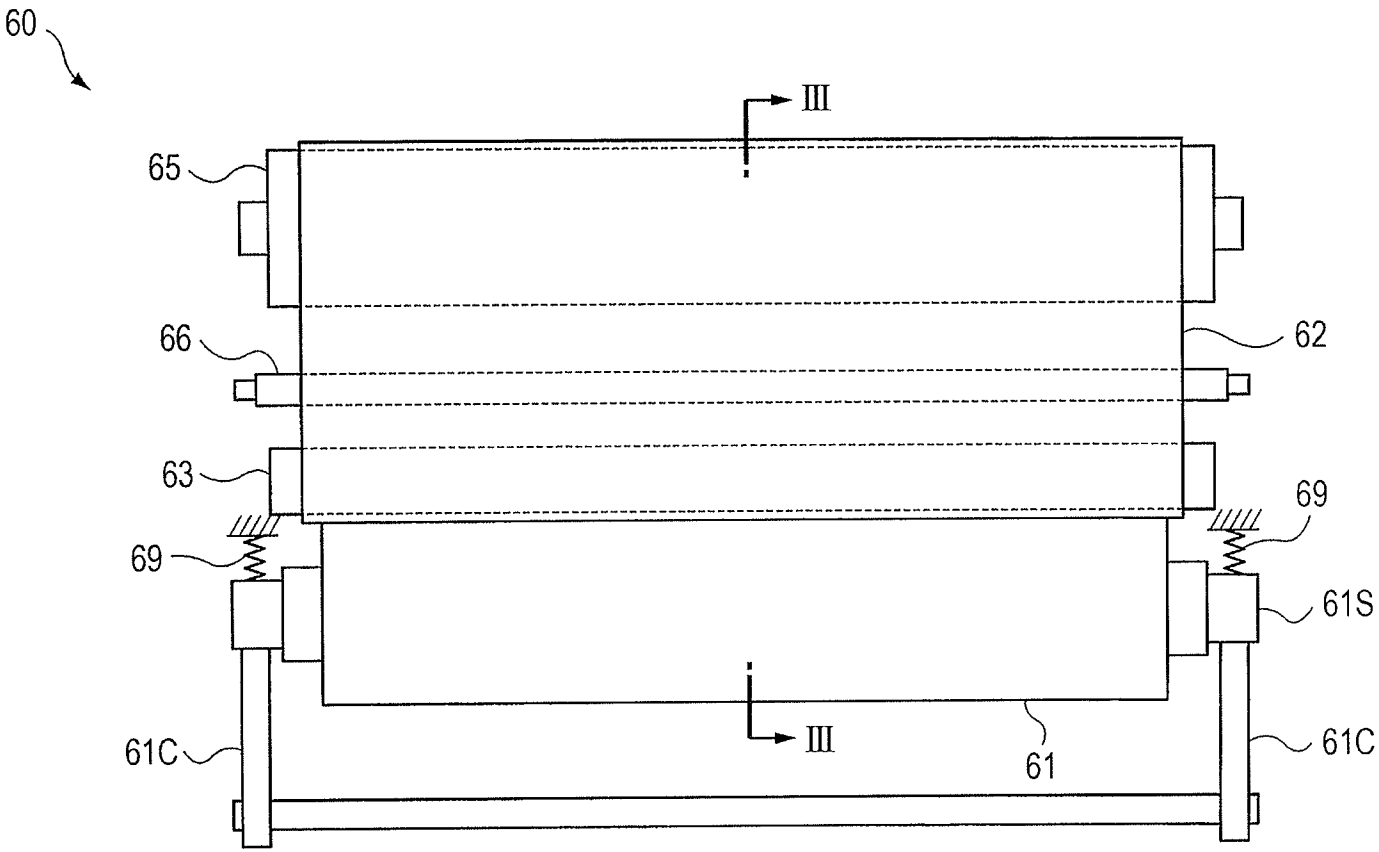
FIG. 2 shows the entire structure of a fixing device according to the exemplary embodiment.
Figure 3:
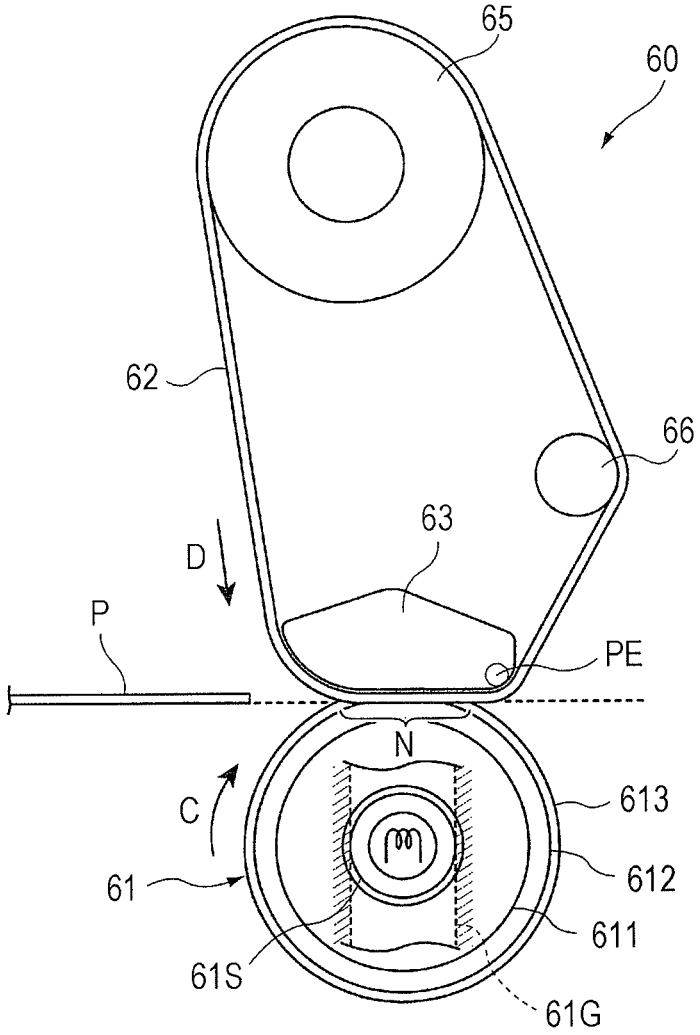
FIG. 3 is a sectional view of the fixing device shown in FIG. 2 taken along line III-III.

FIG. 2 shows the entire structure of the fixing device 60 according to the exemplary embodiment. FIG. 3 is a sectional view of the fixing device 60 shown in FIG. 2 taken along line III-III.

As shown in FIG. 2, the fixing device 60 to which the exemplary embodiment is applied includes a pressure roller 61, a fixing belt 62, a pressing pad 63, a roller 65, and a tension roller 66. The pressure roller 61 serves as an exemplary pressure member. The fixing belt 62 serves as an exemplary belt member that is press-contacted by the pressure roller 61, and that rotates. The pressing pad 63 serves as an exemplary pressing member that is pressed by the pressure roller 61 via the fixing belt 62. The fixing belt 62 is placed around the roller 65 and the pressing pad 63 in a tensioned state. The tension roller 66 applies a predetermined tension to the fixing belt 62.

Structure of Pressure Roller

As shown in FIG. 3, the pressure roller 61 is a cylindrical roller having a three-layer structure including a cylindrical core bar 611, an elastic layer 612, and a release layer 613. The cylindrical core bar 611 is formed of metal. The elastic layer 612 may be formed of, for example, silicone rubber. The release layer 613 may be formed of, for example, fluorocarbon resin. The elastic layer 612 and the release layer 613 are formed around the core bar 611. The pressure roller 61 is rotatably supported, and rotates in the direction of arrow C at a predetermined surface velocity. The pressure roller 61 according to the exemplary embodiment is a straight roller whose outer diameter is constant in an axial direction.

For example, a halogen heater having a rated power of 600 W is disposed as a heat-generating source in the interior of the pressure roller 61. A temperature sensor (not shown) is disposed at the surface of the pressure roller 61 so as to contact therewith. The controller 40 (see FIG. 1) of the image forming apparatus 1 controls turning on of the halogen heater serving as the heat-generating source on the basis of a measured temperature value obtained from the temperature sensor, and adjusts the surface temperature of the pressure roller 61 so that it is maintained at a predetermined set temperature (such as 175° C.).

As shown in FIG. 3, guides 61G having grooves formed so as to extend towards the pressing pad 63 are provided at respective end portions of the pressure roller 61 in the axial direction. A rotary shaft 61S of the pressure roller 61 is slidably fitted in the grooves of the guides 61G. As shown in FIG. 2, disc cams 61C whose distances from the centers of rotation to the respective circumferences are not constant are disposed at respective end portions of the rotary shaft 61S of the pressure roller 61 so as to contact therewith. Coil springs 69 that push the rotary shaft 61S towards the disc cams 61C are mounted to the rotary shaft 61S. The pressure roller 61 is urged towards the fixing belt 62 as a result of contact of the disc cams 61 with the pressure roller 61. The pressure roller 61 holds the fixing belt 62 as a result of interposing the fixing belt 62 between the pressure roller 61 and the pressing pad 63. Then, as shown in FIG. 3, a nip part N serving as an area where the pressure roller 61 press-contacts the pressing pad 63 through the fixing belt 62 is formed.

Further, at the fixing device 60, when the disc cams 61C are rotated by driving motors (not shown), pressure at the nip part N that is formed between the pressure roller 61 and the fixing belt 62 is adjusted. More specifically, a long-diameter side of the each disc cam 61C is brought into contact with the rotary shaft 61S, so that the pressure roller 61 is moved along the guides 61G, and brought closer to the fixing belt 62. Then, in the fixing device 60, pressure (nip pressure) applied to the fixing belt 62 by the pressure roller 61 is set to a high state (high-pressure state). In contrast, a short-diameter side of each disc cam 61C is brought into contact with the rotary shaft 61S, so that the pressure roller 61 is moved away from the fixing belt 62. This causes the nip pressure in the fixing device 60 to be in a low state (low-pressure state).

Although, in the above-described exemplary embodiment, a structure in which a heat-generating source is provided in the interior of the pressure roller 61 is used, the present invention is not limited to this structure. For example, heat-generating sources may be provided in the interiors of the tension roller 66 and the roller 65 around which the fixing belt 62 is placed in a tensioned state. In addition, it is possible to set a heating device that heats the fixing belt 62 outside the fixing belt 62.

Structure of Fixing Belt

The fixing belt 62 is a cylindrical endless belt that is seamless. The fixing belt 62 includes a base layer and a surface layer. The base layer may be formed of, for example, polyimide resin. The surface layer may be formed of, for example, fluorocarbon resin that covers a pressure-roller-61-side surface or both surfaces of the base layer. An elastic layer may be provided between the base layer and the surface layer of the fixing belt 62. In this case, the elastic layer may be formed of, for example, silicone rubber whose hardness is, for example, 35° (Asker C) and whose thickness is 300 μm.

The fixing belt 62 is rotatably supported by the pressing pad 63, the roller 65, and the tension roller 66, which are disposed at the inner side of the fixing belt 62. The fixing belt 62 is disposed so as to be press-contacted by the pressure roller 61 and so as to form the nip part N through which a sheet P passes. The fixing belt 62 is driven by the pressure roller 61, and rotates in the direction of arrow D.

Structure of Pressing Pad

The pressing pad 63 may be formed of, for example, heat-resistant resin or a metal such as iron or SUS. The surface of the pressing pad 63 is formed of an elastic material such as silicone rubber or fluorocarbon rubber. As shown in FIG. 2, the pressing pad 63 is formed so that, in a widthwise direction of the fixing belt 62 (that is, in a direction crossing a movement direction of a sheet P), the pressing pad 63 is disposed in an area that is wider than an area along which the sheet P passes (feeding area), and so that the pressing pad 63 is pressed by the pressing roller 61 over the entire length of the pressing pad 63 in a longitudinal direction. The elastic material that is provided at the surface of the pressing pad 63 is not required. That is, the elastic material need not be provided on the surface of the pressing pad 63.

A lubricant, such as heat-resistant grease, may be applied between the pressing pad 63 and the fixing belt 62 for reducing sliding friction force between the pressing pad 63 and the fixing belt 62 at the nip part N. This makes it possible to smoothly rotate the fixing belt 62. In addition to applying a lubricant, it is possible to use, for example, a structure that allows smooth rotation of the fixing belt 62 by, for example, inserting a member that reduces friction resistance between the fixing belt 62 and the pressing pad 63.

As shown in FIG. 3, by holding the fixing belt 62 with the pressing pad 63, a curved portion is formed in the fixing belt 62 at a downstream-side end portion (hereunder referred to as "pad end portion PE") of the pressing pad 63. A sheet P that reaches the curved portion of the fixing belt 62 formed by the pad end portion PE is separated from the fixing belt 62 by a change in curvature of the fixing belt 62. Accordingly, in the fixing device 60 to which the exemplary embodiment is applied, a separation position of the sheet P at the fixing belt 62 is set on the basis of the position of the pad end portion PE.

Here, with reference to FIGS. 4A and 4B, a change in the width of the nip part N as a compressive force applied to the fixing belt 62 by the pressure roller 61 changes will be described in detail.

Figure 4B:
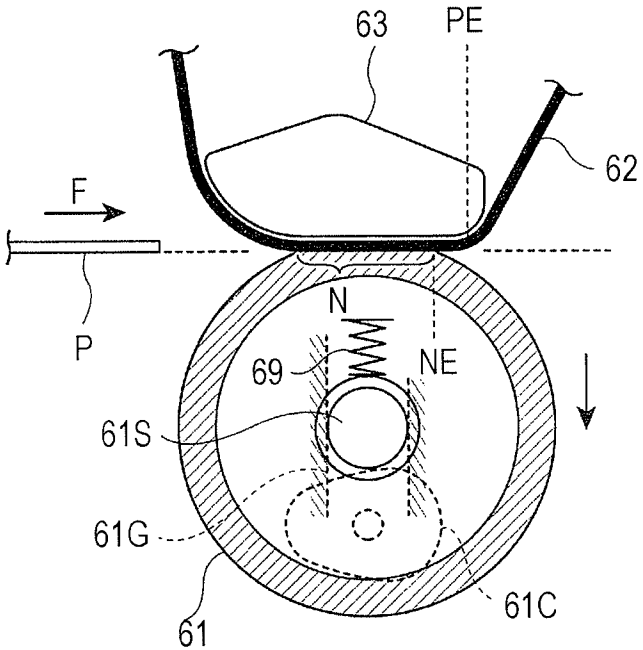
FIGS. 4A and 4B illustrate a high-pressure state and a low-pressure state of the fixing device.
Figure 4A:
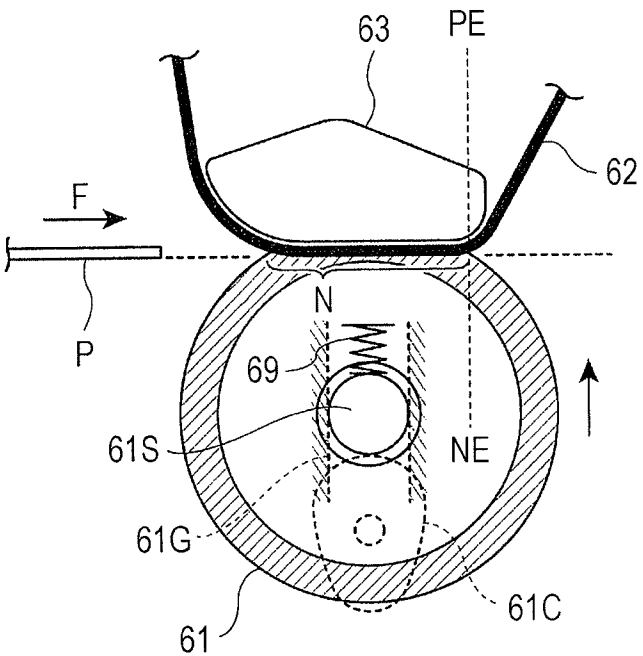

FIG. 4A illustrates the fixing device 60 in the high-pressure state, whereas FIG. 4B illustrates the fixing device 60 in the low-pressure state.

In the exemplary embodiment, for example, the controller 40 adjusts the nip pressure in the fixing device 60 on the basis of information regarding the thickness of a sheet P obtained when a print instruction is received. The adjustment of the nip pressure is performed for, for example, achieving optimal gloss in accordance with a sheet P. In the exemplary embodiment, fixing is performed on thick paper while the nip pressure generated by the pressure roller 61 is set high. In contrast, fixing is performed on thin paper while the nip pressure generated by the pressure roller 61 is set low.

As shown in FIG. 4A, by bringing the long-diameter side of each disc cam 61C into contact with the rotary shaft 61S of the pressure roller 61, the pressure roller 61 is pressed towards and into the pressing pad 63. As shown in FIG. 4A, the nip part N is formed by the pressure roller 61 and the fixing belt 62. In this state, the position of a downstream-side end portion of the nip part N (hereunder referred to as "nip end portion NE") and the position of the pad end portion PE are aligned with each other.

In contrast, by bringing the short-diameter side of each disc cam 61C into contact with the rotary shaft 61S of the pressure roller 61, the distance between the pressure roller 61 and the fixing belt 62 is larger than that when the fixing device 60 is in the high pressure state. As a result, as shown in FIG. 4B, the width of the nip part N in the low-pressure state is less than the width of the nip part N in the high-pressure state. Therefore, the position of the nip end portion NE in the low-pressure state moves towards an upstream side of the nip part N compared to that in the high-pressure state. Here, when the nip pressure changes from the high-pressure state to the low-pressure state, the position of the pad end portion PE of the pressing pad 63 does not change. Therefore, a certain gap is formed between the pad end portion PE and the nip end portion NE. In between the pad end portion PE and the nip end portion NE, an area where a sheet P does not receive pressure from the pressure roller 61 (hereunder referred to as "no-pressure application area") is formed.

Ordinarily, a sheet P moves along the fixing belt 62. As shown in FIGS. 4A and 4B, the sheet P is not capable of following the fixing belt 62 at the curved portion of the fixing belt 62 that is positioned at the pad end portion PE, as a result of which the sheet P tries to separate from the fixing belt 62.

Here, it is known that, for example, as in the low-pressure state shown in FIG. 4B, with increasing distance between the pad end portion PE and the nip end portion NE, even if a curved portion is formed, it becomes difficult to separate the sheet P from the fixing belt 62. Therefore, unless the distance between the pad end portion PE and the nip end portion NE is within a predetermined range, the separability is reduced.

In the exemplary fixing device 60 to which the exemplary embodiment is applied, for maintaining the separability, it is desirable for the length of the no-pressure application area to be within, for example, 500 μm or less.

In the exemplary embodiment, if the sheet P to be subjected to a fixing operation is, for example, a thin sheet, the nip pressure in the fixing device 60 is set in the low-pressure state and the fixing operation is performed for providing the sheet P with optimal gloss. Here, if the sheet P is a thin sheet, the stiffness of the sheet P is weak, as a result of which the separability of the thin sheet P is less than that of a thick sheet having a strong stiffness. Therefore, when, in order to reduce the nip pressure in the nip part N, the pressure roller 61 is moved away from the pressing pad 63, the no-pressure application area is consequentially increased, thereby further reducing the separability.

In addition, when the distance between the pad end portion PE and the nip end portion NE is increased, so that the length of the no-pressure application area is increased, it is known that what is called blistering tends to occur. In the blistering, a defect occurs in an image due to, for example, water vapor or expanding air generated from heated toner or sheet P. This causes an image defect to occur. Consequently, from the viewpoint of suppressing the occurrence of image defect, it is necessary to set the length of the no-pressure application area within a certain range.

Accordingly, the fixing device 60 to which the exemplary embodiment is applied is provided with an adjusting mechanism that adjusts the length of the no-pressure application area so that it is within a certain range before and after the compressive force applied to the fixing belt 62 by the pressure roller 61 is changed.

Figure 5A:
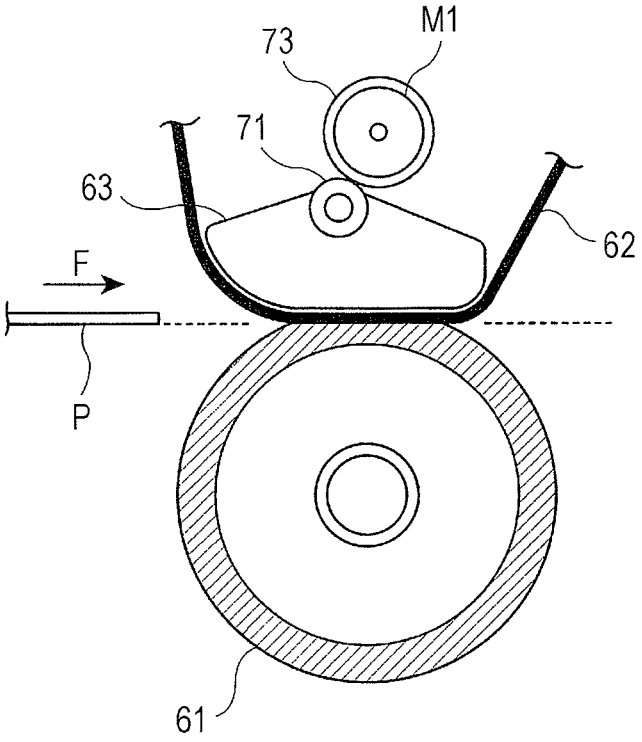
FIGS. 5A and 5B illustrate an adjusting mechanism of a fixing device to which a first exemplary embodiment is applied.
Figure 5B:
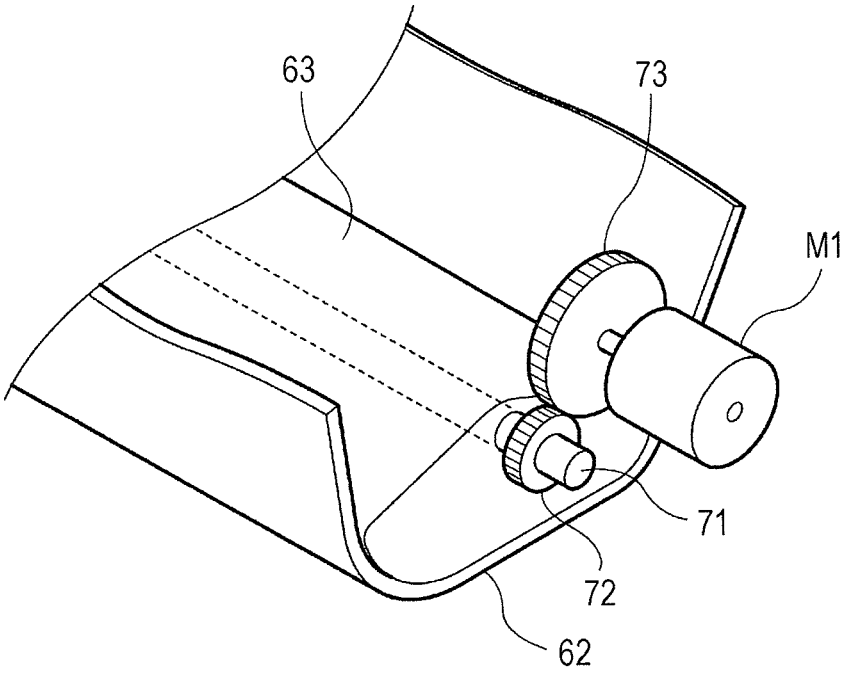

FIGS. 5A and 5B illustrate an adjusting mechanism (an adjusting section) of the fixing device 60 to which a first exemplary embodiment is applied.

As shown in FIG. 5A, the fixing device 60 according to the first exemplary embodiment is provided with a rotary shaft 71 that rotatably holds the pressing pad 63. As shown in FIG. 5B, the rotary shaft 71 is mounted along a widthwise direction of the pressing pad 63. A gear 72 is secured to the rotary shaft 71. Power is transmitted to the rotary shaft 71 from a gear 73, connected to a driving motor M1, through the gear 72. By rotating the rotary shaft 71 by a predetermined angle, a rotation angle of the pressing pad 63 is adjusted. The pressing pad 63 is capable of rotating either in a forward direction or a reverse direction. Therefore, the pressing pad 63 rotates around the rotary shaft 71 either in a direction of the upstream side or in a direction of a downstream side of the nip part N. The driving motor M1 according to the exemplary embodiment may be, for example, a stepping motor.

As described with reference to FIGS. 4A and 4B, in the fixing device 60 to which the exemplary embodiment is applied, the nip pressure is set to two pressure states, that is, the high-pressure state and the low-pressure state. The adjusting mechanism rotates the pressing pad 63 in accordance with each state, to adjust the position of the nip end portion NE and the position of the pad end portion PE. For example, when the nip pressure is changed from the high-pressure state to the low-pressure state, with reference to the rotation angle of the pressing pad 63 in the high-pressure state, the rotary shaft 71 is rotated by a predetermined rotation angle in a predetermined rotation direction. The predetermined rotation direction and the predetermined rotation angle are specified on the basis of a direction and an angle that allow the position of the pad end portion PE to be aligned with the position of the nip end portion NE.

In the first exemplary embodiment, the rotary shaft 71 and the driving motor M1 function as the adjusting section.

Next, the operation of the fixing device 60 to which the first exemplary embodiment is applied will be described.

Figure 6B:
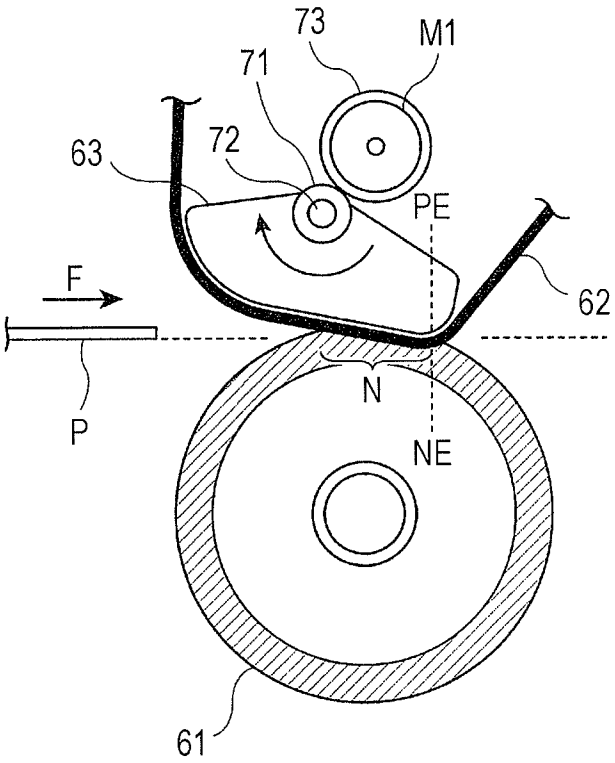
FIGS. 6A and 6B illustrate the operations of the fixing device to which the first exemplary embodiment is applied.
Figure 6A:
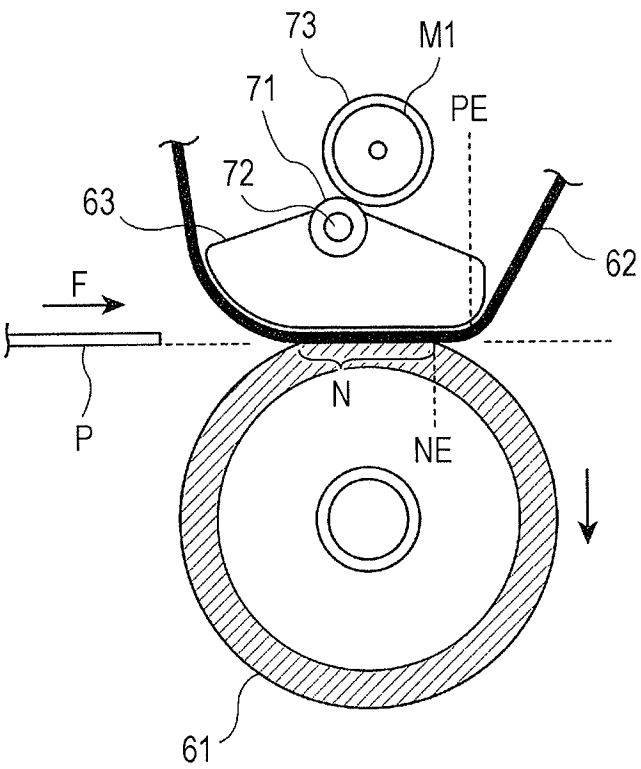

FIGS. 6A and 6B illustrate the operations of the fixing device 60 to which the first exemplary embodiment is applied.

In the image forming apparatus 1 according to the exemplary embodiment, when the controller 40 receives an image formation instruction, the controller 40 causes formation of toner images at the image forming units to be started. Then, the controller 40 causes the fixing device 60 that fixes the toner images formed on a sheet P to operate.

Here, when a sheet P to be subjected to a fixing operation is, for example, a thin sheet, if a nip pressure state in the current fixing device 60 is set to a high-pressure state, the nip pressure is changed from the high-pressure state to a low-pressure state. More specifically, as described with reference to FIGS. 4A and 4B, the disc cams 61C are rotated by the driving motors (not shown). The disc cams 61C cause the pressure roller 61 to move away from the fixing belt 62, so that the nip pressure in the nip part N is set to the low-pressure state.

Then, the rotary shaft 71 of the pressing pad 63 is rotated in the direction of an arrow shown in FIG. 6B by the driving motor M1. The rotary shaft 71 rotates the pressing pad 63 towards the upstream side of the nip part N (that is, a sheet-P entrance side of the nip part N). In the low-pressure state shown in FIG. 6A, the nip end portion NE is positioned upstream from the pad end portion PE. Then, by rotating the pressing pad 63 towards the upstream side of the nip part N, the position of the pad end portion PE moves towards the upstream side of the nip part N. As a result, the position of the nip end portion NE and the position of the pad end portion PE (curved portion) are aligned with each other.

In the exemplary embodiment, after changing the nip pressure from the high-pressure state to the low-pressure state, the pressing pad 63 is moved. This makes it possible for a load of the driving motor M1 when the pressing pad 63 is rotated to be at least lower than that when the fixing device 60 is operated in the high-pressure state. In contrast, when the nip pressure is to be changed from the low-pressure state to the high-pressure state, the pressing pad 63 is first rotated, and, then, the nip pressure is changed from the low-pressure state to the high-pressure state.

With the fixing belt 62 being heated to a predetermined temperature, a sheet P having unfixed toner images formed thereon is transported into the nip part N that is formed between the fixing belt 62 and the pressure roller 61. In the nip part N, the sheet P and the toner images that are formed on the sheet P are heated and subjected to pressure, so that the toner images are fixed to the sheet P. Thereafter, a change in the curvature of the curved portion of the fixing belt 62 that is positioned at the pad end portion PE allows the sheet P to be separated from the fixing belt 62 and to be transported towards the sheet-discharge stacking unit.

When the nip pressure changes from the low-pressure state to the high-pressure state, the driving motor M1 is driven to rotate the rotary shaft 71 in a direction opposite to the direction of the arrow shown in FIG. 6B. The rotary shaft 71 causes the pressing pad 63 to rotate towards the downstream side of the nip part N (a sheet-P exist side of the nip part N). As a result, the position of the nip end portion NE and the position of the pad end portion PE (curved portion) are aligned with each other.

Second Exemplary Embodiment

Next, a fixing device 60 to which a second exemplary embodiment is applied will be described. Members, etc. corresponding to those described in the first exemplary embodiment are given the same reference numerals, and will not be described in detail below.

Figure 7A:
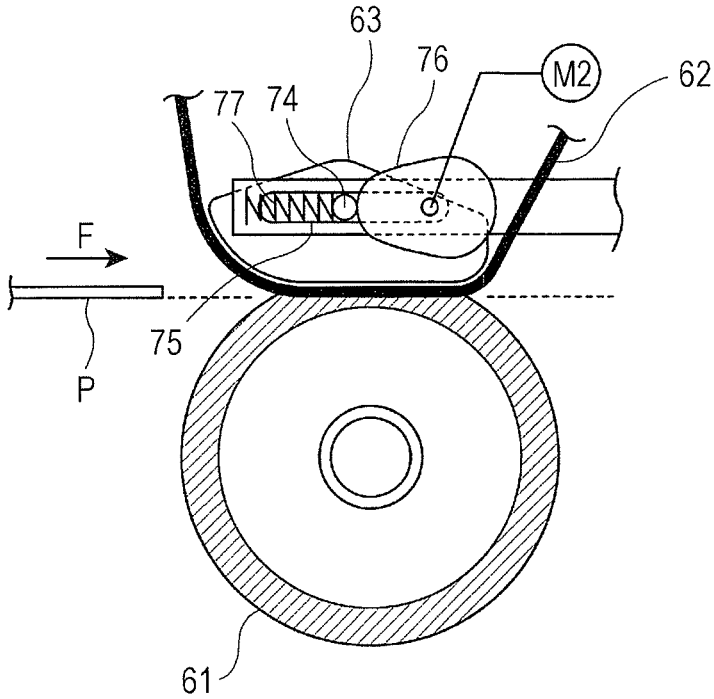
FIGS. 7A and 7B illustrate an adjusting mechanism of a fixing device to which a second exemplary embodiment is applied.
Figure 7B:
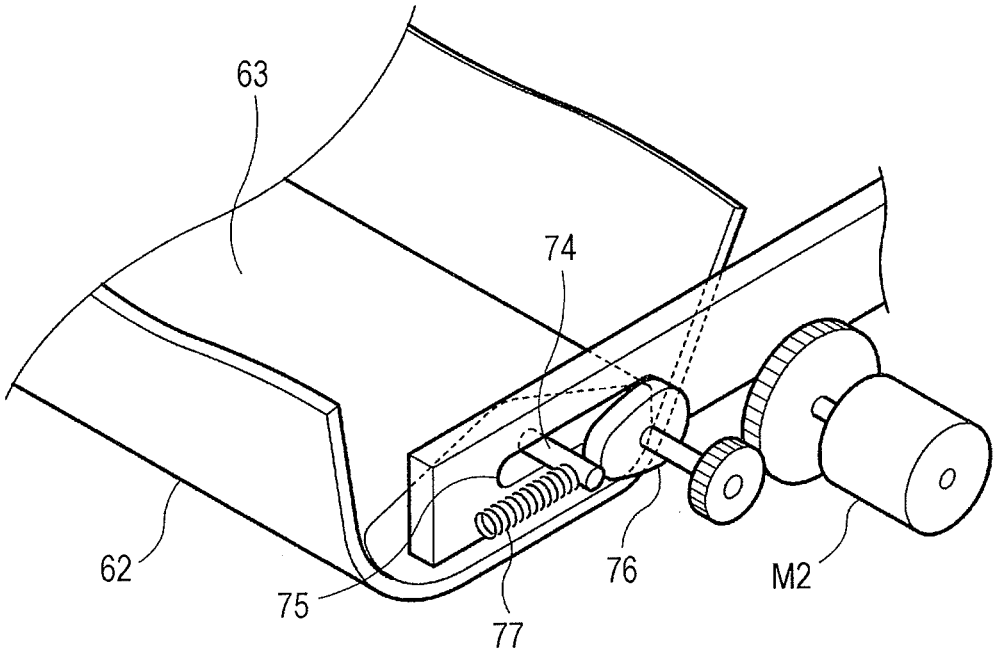

FIGS. 7A and 7B illustrate an adjusting mechanism (adjusting section) of the fixing device 60 to which the second exemplary embodiment is applied.

As shown in FIG. 7A, in the fixing device 60 to which the second exemplary embodiment is applied, projections 74 are provided on respective end portions of a pressing pad 63 in a widthwise direction thereof (only the projection 74 at one end portion is shown in FIG. 7A). The fixing device 60 includes guides 75 that are mounted to a housing (not shown) and that rotatably hold the projections 74. As shown in FIG. 7B, grooves of the guides 75 are provided along a movement direction F of a sheet P in a nip part N (that is, in a direction in which the nip part N is formed). The fixing device 60 is provided with coil springs 77 and disc cams 76 that contact the respective projections 74 and whose distances from the centers of rotation to the respective circumferences are not constant. The disc cams 76 are connected to respective driving motors M2. The disc cams 76 receive driving force from the driving motors M2, and rotate. The driving motors M2 according to the exemplary embodiment may be stepping motors.

The coil springs 77 push the projections 74 towards the disc cams 76. As shown in FIG. 7B, the projections 74 of the pressing pad 73 are rotatably supported by the guides 75, and are provided so as to be interposed between the disc cams 76 and the respective coil springs 77.

As described with reference to FIGS. 4A and 4B, the nip pressure of the fixing device 60 according to the second exemplary embodiment is set to two pressure states, that is, a high-pressure state in which the nip pressure is high and a low-pressure state in which the nip pressure is low. In the fixing device 60 to which the second exemplary embodiment is applied, in accordance with the nip pressure state, the pressing pad 63 is guided by the guides 75, and moves along the movement direction F of a sheet P at the nip part N. For example, when the nip pressure is changed from the high-pressure state to the low-pressure state, with reference to the position of the pressing pad 73 in the high-pressure state, the projections 74 that are secured to the pressing pad 63 are moved in a predetermined direction by a predetermined distance. The predetermined direction and the predetermined distance are specified on the basis of a direction and a distance that allow the position of a pad end portion PE to be aligned with the position of a nip end portion NE.

In the second exemplary embodiment, the projections 74, the guides 75, the disc cams 76, the coil springs 77, and the driving motors M2 function as an adjusting section.

Figure 8B:
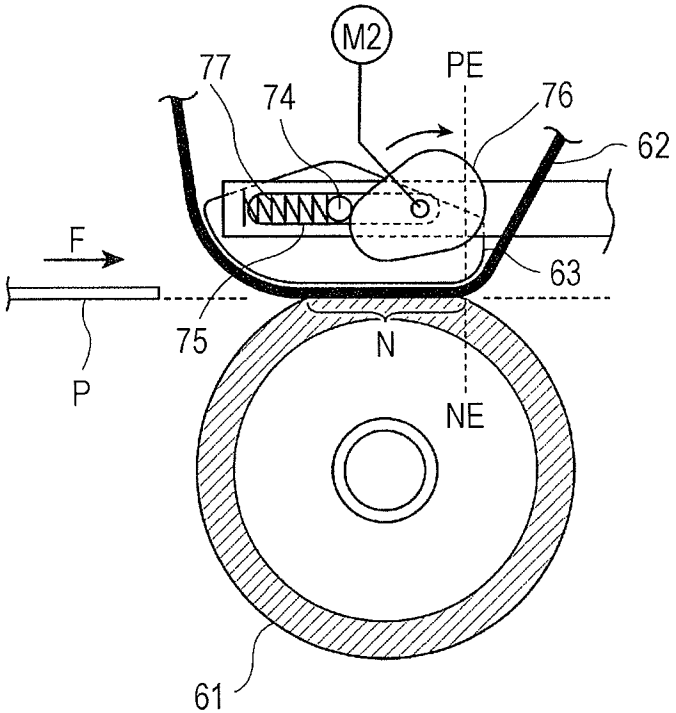
FIGS. 8A and 8B illustrate the operations of the fixing device to which the second exemplary embodiment is applied.
Figure 8A:
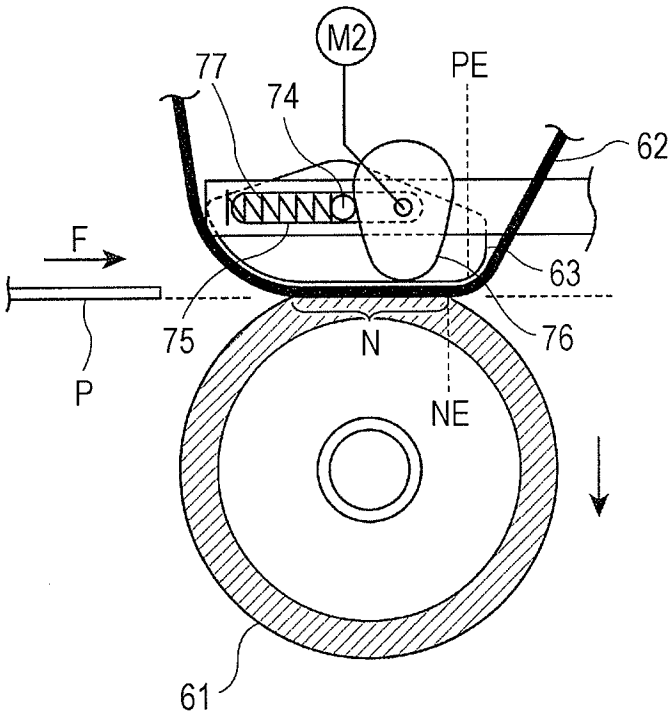

FIGS. 8A and 8B illustrate the operations of the fixing device 60 to which the second exemplary embodiment is applied.

A controller 40 causes the fixing device 60 to operate on the basis of a print instruction. First, the controller 40 moves a pressure roller 61, to set the nip pressure in the nip part N. For example, if a sheet P to be subjected to a fixing operation is a thin sheet, and if the nip pressure is set at the high-pressure state when the instruction is received, the pressure roller 61 moves away from a fixing belt 62, so that the nip pressure changes from the high-pressure state to the low-pressure state. More specifically, disc cams 61C (see FIG. 2) are rotated by driving motors (not shown). Then, a short-diameter side of each disc cam 61C is brought into contact with a rotary shaft 61S of the pressure roller 61, and the pressure roller 61 is moved away from the fixing belt 61 as shown in FIG. 8A. This causes the nip pressure of the nip part N generated by the pressure roller 61 to be set to the low-pressure state.

Thereafter, the driving motors M2 are driven to rotate the disc cams 76 in the direction of an arrow shown in FIG. 8B. Then, a large-diameter side of each disc cam 76 is brought into contact with the corresponding projection 74. The projections 74 move against spring forces of the coil springs 77 towards an upstream side of the nip part N. At this time, the projections 74 are guided by the grooves of the guides 75, and move along the direction in which the nip part N is formed. Here, in the low-pressure state shown in FIG. 8A, the pad end portion PE is positioned downstream from the nip end portion NE. In addition, as mentioned above, by changing the position of the pressing pad 63, the position of the pad end portion PE moves from a downstream side of the nip part N to the upstream side of the nip part N, so that the position of the nip end portion NE and the position of the pad end portion PE (curved portion) are aligned with each other.

When the nip pressure is changed from the low-pressure state to the high-pressure state, the driving motors M2 rotate the disc cams 76 in a direction opposite to the direction of the arrow shown in FIG. 8B. The projections 74 are brought into contact with short-diameter sides of the disc cams 76. Then, the projections 74 are pushed back by the respective coil springs 77. At this time, the projections 74 are guided by the guides 75, and move towards the downstream side of the nip part N. Even in this case, the position of the nip end portion NE and the position of the pad end portion PE (curved portion) are aligned with each other.

Third Exemplary Embodiment

Next, a fixing device 60 to which a third exemplary embodiment is applied will be described. Members, etc. corresponding to those described in the first exemplary embodiment are given the same reference numerals, and will not be described in detail below.

Figure 9A:
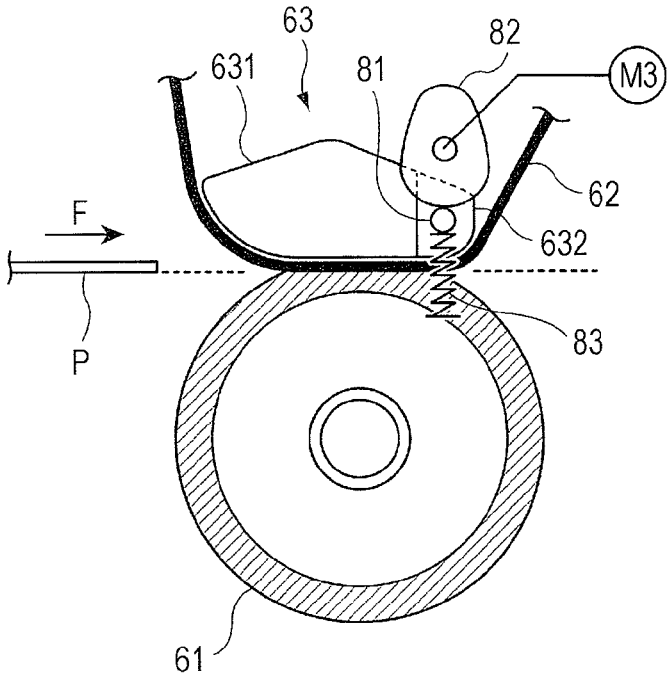
FIGS. 9A and 9B illustrate an adjusting mechanism of a fixing device to which a third exemplary embodiment is applied.
Figure 9B:
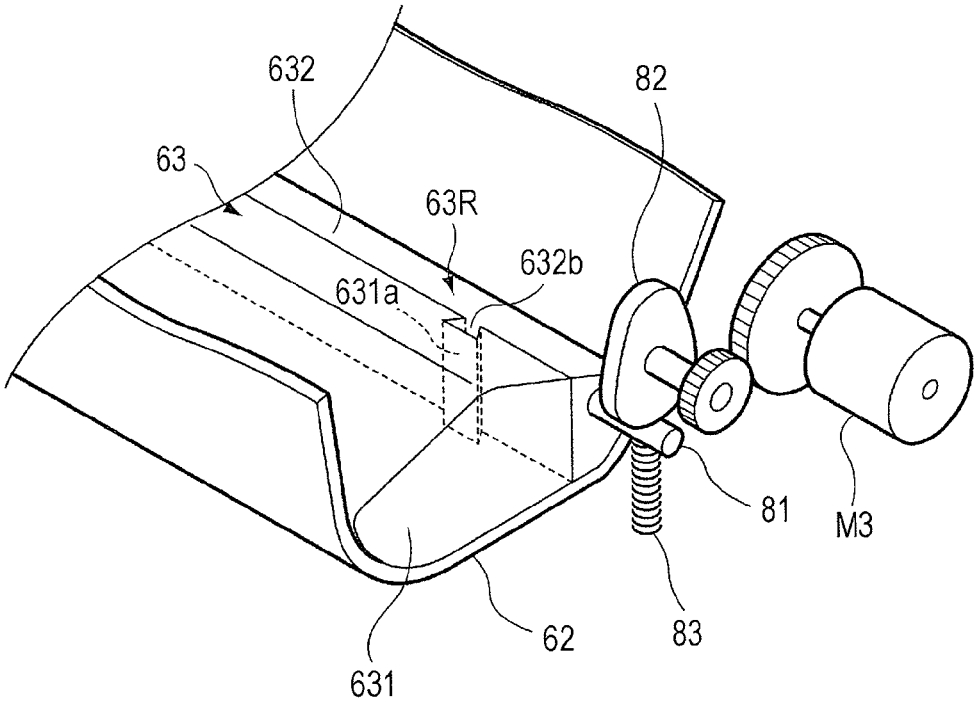

FIGS. 9A and 9B illustrate an adjusting mechanism (adjusting section) of the fixing device 60 to which the third exemplary embodiment is applied.

A pressing pad 63 according to the third exemplary embodiment includes blocks that are divided in a movement direction of a fixing belt 62 (that is, in a movement direction F of a sheet P at a nip part P). As shown in FIG. 9A, the pressing pad 63 according to the third exemplary embodiment includes a first pressing pad 631, which is positioned at an upstream side of the nip part N, and a second pressing pad 632, which is positioned at a downstream side of the nip part N. As shown in FIG. 9B, the first pressing pad 631 and the second pressing pad 632 are connected to each other. A connecting portion 63R that connects the first pressing pad 631 and the second pressing pad 632 to each other is formed by a groove 631*a* and a protrusion 632*b* that allow the members to engage each other. In the exemplary embodiment, the groove 631*a* and the protrusion 632*b* constituting the connecting portion 63R are formed in a direction that is perpendicular to the nip part N.

The first pressing pad 631 is secured to a housing (not shown). The second pressing pad 632 is capable of sliding along the groove 631*a* of the connecting portion 63R. In addition, the second pressing pad 632 moves towards and away from a surface of a fixing belt 62 constituting the nip part N.

Driving for moving the second pressing pad 632 towards and away from the fixing belt 62 is performed by the following mechanism. Projections 81 are provided on respective end portions of the pressing pad 632 in a widthwise direction thereof (only the projection 81 at one end portion of the second pressing pad 632 is shown in FIGS. 9A and 9B). A disc cam 82 and a coil spring 83 contact the corresponding projection 81. Each disc cam 82 has a shape in which the distance from the center of rotation to the circumference is not constant, and presses the corresponding projection 81 towards the nip part N. Each coil spring 83 pushes the corresponding projection 81 towards the corresponding disc cam 82. Driving motors M3 are connected to the respective disc cams 82. The disc cams 82 receive driving forces from the driving motors M3, and rotate. The driving motors M3 according to the exemplary embodiment may be stepping motors.

As described with reference to FIGS. 4A and 4B, the nip pressure of the fixing device 60 according to the third exemplary embodiment is set to two pressure states, that is, a high-pressure state in which the nip pressure is high and a low-pressure state in which the nip pressure is low. The adjusting mechanism of the fixing device 60 according to the third exemplary embodiment causes the second pressing pad 632 to move away from or contact the nip part N in accordance with each state. For example, in the low-pressure state, the adjusting mechanism causes the second pressing pad 632 to move away from and retreat from the fixing belt 62. In contrast, in the high-pressure state, the adjusting mechanism causes the second pressing pad 632 to move towards and contact the fixing belt 62.

The position of a boundary between the first pressing pad 631 and the second pressing pad 632 is set so that the position of a nip end portion NE and the position of a pad end portion PE are aligned with each other before and after the nip pressure changes. That is, the position of the boundary between the first pressing pad 631 and the second pressing pad 632 is set at the position of the nip end portion NE that is provided in the low-pressure state.

In the third exemplary embodiment, the projections 81, the disc cams 82, the coil springs 83, and the driving motors M3 function as the adjusting section.

Figure 10B:
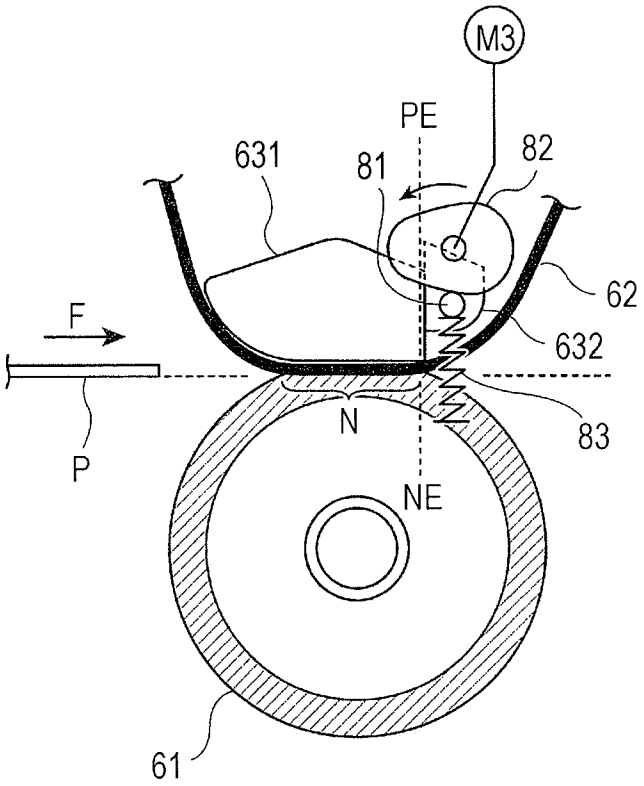
FIGS. 10A and 10B illustrate the operations of the fixing device to which the third exemplary embodiment is applied.
Figure 10A:
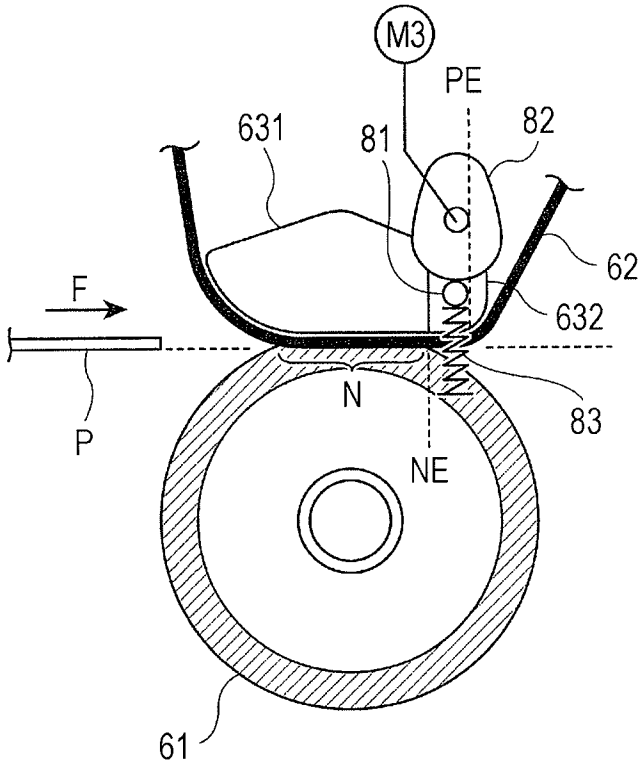

FIGS. 10A and 10B illustrate the operations of the fixing device 60 to which the third exemplary embodiment is applied.

A controller 40 causes the fixing device 60 to operate on the basis of a print instruction. For example, if a sheet P to be subjected to a fixing operation is a thin sheet, and if the nip pressure is set at the high-pressure state when the instruction is received, a pressure roller 61 moves away from a fixing belt 62, so that the nip pressure changes from the high-pressure state to the low-pressure state. More specifically, disc cams 61C (see FIG. 2) are rotated by driving motors (not shown). Then, a short-diameter side of each disc cam 61C is brought into contact with a rotary shaft 61S of the pressure roller 61, and the pressure roller 61 is moved away from the fixing belt 61 as shown in FIG. 8A. This causes the nip pressure of the nip part N generated by the pressure roller 61 to be set to the low-pressure state.

Thereafter, the driving motors M3 are driven to rotate the disc cams 82 in the direction of an arrow shown in FIG. 10B. Then, when the short-diameter side of each disc cam 82 is brought into contact with the corresponding projection 81, each projection 81 is moved away from the nip part N by its corresponding coil spring 83. Then, the second pressing pad 632 moves away from the fixing belt 62.

Here, in the low-pressure state shown in FIG. 10A, the pad end portion PE is formed by a downstream-side end portion of the second pressing pad 632. Then, as mentioned above, by moving the second pressing pad 632 away from the fixing belt 62, the pad end portion PE is formed by a downstream-side end portion of the first pressing pad 631. In the exemplary embodiment, for example, a tension roller 66 (see FIG. 2) applies tension to the fixing belt 62. Therefore, after the second pressing pad 632 moves away from the fixing belt 62, the downstream-side end portion of the first pressing pad 631 forms a curved portion of the fixing belt 62.

The first pressing pad 631 is positioned upstream from the second pressing pad 632. Therefore, by moving the second pressing pad 632 away from the fixing belt 62, the position of the pad end portion PE (curved portion) moves from the downstream side to the upstream side of the nip part N before and after the nip pressure changes. As a result, the position of the nip end portion NE and the position of the pad end portion PE (curved portion) are aligned with each other.

When the nip pressure changes from the low-pressure state to the high-pressure state, the driving motors M3 rotate the disc cams 82 in a direction opposite to the direction of the arrow shown in FIG. 10B. Long-diameter sides of the disc cams 82 contact the respective projections 81. The second pressing pad 632 provided with the projections 81 try to move along the grooves 631*a* of the connecting portion 63R. Therefore, the second pressing pad 632 moves towards the fixing belt 62 forming the nip part N, and eventually contacts the fixing belt 62.

In the exemplary embodiment, the pressing pad 63 is described as being divided in two. Here, the number of divisions of the pressing pad 63 may be three or more. In this case, of three or more blocks of the pressing pad 63 that is divided into the three or more blocks, the block that is positioned at a downstream side in the movement direction F of a sheet P is moved towards or away from the fixing belt 62, to align the position of the nip end portion NE and the position of the pad end portion PE (curved portion) with each other.

Fourth Exemplary Embodiment

Next, a fixing device 60 to which a fourth exemplary embodiment is applied will be described. Members, etc. corresponding to those described in the first exemplary embodiment are given the same reference numerals, and will not be described in detail below.

Figure 11:
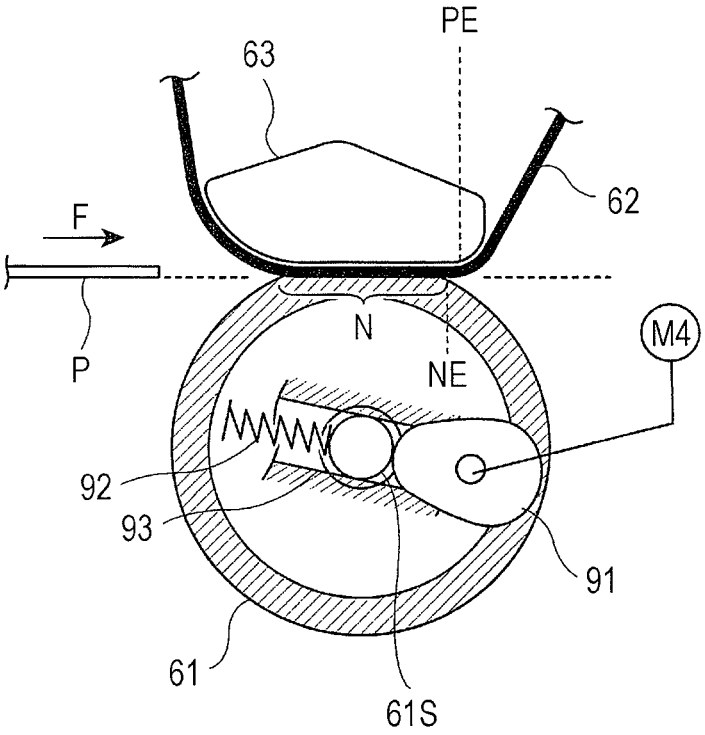
FIG. 11 illustrates an adjusting mechanism of a fixing device to which a fourth exemplary embodiment is applied.

FIG. 11 illustrates an adjusting mechanism (adjusting section) of the fixing device 60 to which the fourth exemplary embodiment is applied.

In the fixing device 60 to which the fourth exemplary embodiment is applied, changing of a nip pressure and alignment of a nip end portion NE and a pad end portion PE with each other are performed at the same time by adjusting a direction of movement of the pressure roller 61 when it is moved.

The fixing device 60 to which the fourth exemplary embodiment is applied includes guides 93 that guide the direction of movement of the pressure roller 61. The guides 93 are formed at respective end portions of the pressure roller 61 in an axial direction thereof. Each guide 93 has a groove having a predetermined shape. A rotary shaft 61S of the pressure roller 61 is slidably fitted to the grooves of the guides 93. As shown in FIG. 11, the groove of each guide 93 has a shape including a component in a direction in which the pressure roller 61 is moved for changing the nip pressure from a low-pressure state to a high-pressure state and a component in a direction in which the pressure roller 61 is moved for aligning the position of the nip end portion NE and the position of the pad end portion PE when the nip pressure is changed.

Here, the shape of the groove of each guide 93 will be described in more detail.

A direction of movement of the pressure roller 61 when the nip pressure is changed from the high-pressure state to the low-pressure state corresponds to a downward direction in FIG. 11 in which the pressure roller 61 moves away from the pressing pad 63. A direction of movement of the pressure roller 61 for moving the nip end portion NE towards and aligning the nip end portion NE with the pad end portion PE (that is positioned downstream relative to the nip end portion NE) when the nip pressure of the fixing device 60 is changed from the high-pressure state to the low-pressure state corresponds to a rightward direction in FIG. 11.

In contrast, a direction of movement of the pressure roller 61 when the nip pressure is changed from the low-pressure state to the high-pressure state corresponds to an upward direction in FIG. 11 in which the pressure roller 61 is moved towards the pressing pad 63. A direction of movement of the pressure roller 61 for moving the nip end portion NE towards and aligning the nip end portion NE with the pad end portion PE when the nip pressure of the fixing device 60 is changed from the high-pressure state to the low-pressure state corresponds to a leftward direction in FIG. 11.

Therefore, as shown in FIG. 11, the groove of each guide 93 is formed so that the changing of the nip pressure and the aligning of the pad end portion PE and the nip end portion NE with each other are performed. More specifically, in the exemplary embodiment, the groove of each guide 93 is formed so as to extend obliquely downward and rightwards in FIG. 11 (that is, obliquely upward and leftwards in FIG. 11) at a predetermined angle from a movement direction F of a sheet P at a nip part N.

In the fixing device 60 to which the fourth exemplary embodiment is applied, a mechanism for moving the pressure roller 61 along the guides 93 has the following structure.

Disc cams 91 and coil springs 92 are disposed at and in contact with the rotary shaft 61S of the pressure roller 61. Each disc cam 91 has a shape in which the distance from the center of rotation to the circumference is not constant. The coil springs 92 push the rotary shaft 61S towards the disc cams 91. Driving motors M4 are connected to the coil springs 92. The disc cams 91 receive rotational driving power from the driving motors M4, and rotate. The driving motors M4 according to the exemplary embodiment may be stepping motors.

In the fourth exemplary embodiment, the disc cams 91, the coil springs 92, the guides 93, and the driving motors M4 function as the adjusting section.

Figure 12:
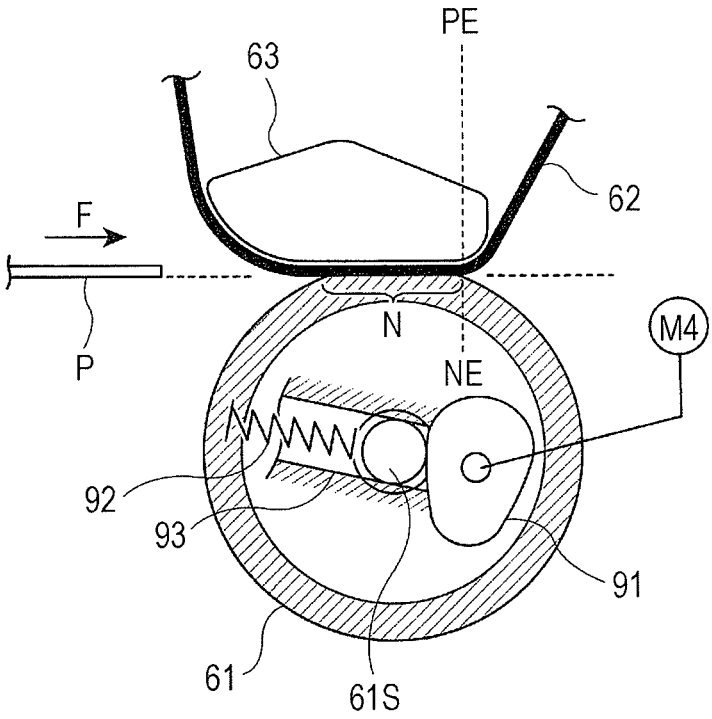
FIG. 12 illustrates the operations of the fixing device to which the fourth exemplary embodiment is applied.

FIG. 12 illustrates the operations of the fixing device 60 to which the fourth exemplary embodiment is applied.

Here, an example in which a sheet P to be subjected to a fixing operation is a thin sheet, and in which the nip pressure in the fixing device 60 is changed from the high-pressure state to the low-pressure state will be described.

In the image forming apparatus 1 according to the exemplary embodiment, when a controller 40 receives an image formation instruction, the controller 40 causes formation of toner images at image forming units to be started. Then, the controller 40 causes the fixing device 60 that fixes the toner images formed on a sheet P to operate.

In this exemplary embodiment, first, the driving motors M4 are driven to rotate the disc cams 91. Then, a short-diameter side of each disc cam 91 comes into contact with the rotary shaft 61S of the pressure roller 61. The rotary shaft 61S of the pressure roller 61 receives force from the coil springs 92, and moves along the guides 93 in a lower-right direction in FIG. 12. That is, the rotary shaft 61S of the pressure roller 61 moves away from the pressing pad 63 from an upstream side to a downstream side of the nip part N.

By moving the pressure roller 61 away from the pressing pad 63, the nip pressure is changed from the high-pressure state to the low-pressure state. By moving the pressure roller 61 from the upstream side to the downstream side in the movement direction F of a sheet P, the position of the nip end portion NE is moved from the upstream side to the downstream side of the nip part N.

Here, as described with reference to FIGS. 4A and 4B, when the pressure roller 61 is moved in a direction perpendicular to a surface of the fixing belt 62 defined by the pressing pad 63, and the low-pressure state is set, the pad end portion PE is positioned downstream from the nip end portion NE.

In contrast, in the fixing device 60 to which the fourth exemplary embodiment is applied, by moving the position of the pressure roller 61 from the upstream side to the downstream side, the position of the nip end portion NE is moved from the upstream side to the downstream side. Accordingly, in the fixing device 60 to which the fourth exemplary embodiment is applied, the position of the nip end portion NE and the position of the pad end portion PE (curved portion) are maintained before and after changing the nip pressure.

As described in each of the first to fourth exemplary embodiments, in the fixing device 60, the position of the nip end portion NE and the position of the pad end portion PE are adjusted as the nip pressure is changed. This suppresses a reduction in the separability of a sheet P at the fixing device 60. It is possible to suppress a reduction in the separability of the sheet P from the fixing belt 62 as long as at least the length of the no-pressure application area is within a predetermined range (such as within 500 μm). Therefore, the present invention is not necessarily limited to eliminating the no-pressure application area by aligning the position of the nip end portion NE and the position of the pad end portion PE with each other.

It is possible to combine, for example, the mode in which the pressing pad 63 is moved and adjusted as described in the second exemplary embodiment and the mode in which the pressure roller 61 is moved and adjusted as described in the fourth exemplary embodiment. That is, the adjustment of the position of the nip end portion NE and the position of the pad end portion PE when the nip pressure is changed may be performed by moving both the pressing pad 63 and the pressure roller 61.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording material;

an endless belt member that is rotatably provided and that has a curved portion;

a pressure member that is provided at an outer peripheral surface of the belt member so as to contact the outer peripheral surface of the belt member, the pressure member applying pressure to the belt member;

a pressing member that presses the belt member from an inner side of the belt member towards the pressure member; and an adjusting section that adjusts a position of an end portion of a nip part at a downstream side in a movement direction of the recording material and a position of the curved portion of the belt member by moving or deforming the pressing member, the nip part being formed by the belt member and the pressure member, the curved portion of the belt member being formed by an end portion of the pressing member at a downstream side in the movement direction of the recording material, wherein the adjusting section adjusts by moving the pressing member towards an upstream side or the downstream side in the movement direction of the recording material, wherein the position of the curved portion of the belt member is located further downstream, in a movement direction of the recording material, than the position of the end portion of the nip part when the adjusting section adjusts by moving the pressing member towards the downstream side in the movement direction of the recording material, and wherein the adjusting section adjusts by causing a portion of the pressing member at the downstream side in the movement direction of the recording material to move away from the belt member or to come into contact with the belt member.

2. The image forming apparatus according to claim 1, wherein the adjusting section adjusts by rotating the pressing member around a predetermined axis.

3. A fixing device comprising:

an endless belt member that is rotatably provided and that has a curved portion;

a pressure member that is provided at an outer peripheral surface of the belt member so as to contact the outer peripheral surface of the belt member, the pressure member applying pressure to the belt member; and a pressing member that presses the belt member from an inner side of the belt member towards the pressure member, wherein a position of the curved portion of the belt member and a position of an end portion of a nip part at a downstream side in a movement direction of a recording material are adjusted by moving the position of the curved portion of the belt member as a result of moving or deforming the pressing member, the curved portion of the belt member being formed by an end portion of the pressing member at a downstream side in the movement direction of the recording material, the nip part being formed by the belt member and the pressure member, wherein the pressing member is moved towards an upstream side or the downstream side of the nip part in the movement direction of the recording material, wherein the position of the curved portion of the belt member is located further downstream, in a movement direction of the recording material, than the position of the end portion of the nip part when the adjusting section adjusts by moving the pressing member towards the downstream side in the movement direction of the recording material, and wherein a portion of the pressing member at the downstream side in the movement direction of the recording material moves away from the belt member or comes into contact with the belt member.

4. The fixing device according to claim 3, wherein the pressing member rotates around a predetermined axis.

5. An image forming apparatus comprising:

an image forming unit that forms an image on a recording material;

an endless belt member that is rotatably provided and that has a curved portion;

a pressure member that is provided at an outer peripheral surface of the belt member so as to contact the outer peripheral surface of the belt member, the pressure member applying pressure to the belt member;

a pressing member that presses the belt member from an inner side of the belt member towards the pressure member; and an adjusting section that adjusts a position of an end portion of a nip part at a downstream side in a movement direction of the recording material and a position of the curved portion of the belt member by moving or deforming the pressing member, the nip part being formed by the belt member and the pressure member, the curved portion of the belt member being formed by an end portion of the pressing member at a downstream side in the movement direction of the recording material, wherein the adjusting section adjusts by moving the pressing member towards an upstream side or the downstream side in the movement direction of the recording material, wherein the position of the curved portion of the belt member is located further downstream, in a movement direction of the recording material, than the position of the end portion of the nip part when the adjusting section adjusts by moving the pressing member towards the downstream side in the movement direction of the recording material, wherein when a nip pressure of the nip part is changed from a high-pressure state to a low-pressure state, the adjusting section moves or deforms the pressing member after the nip pressure is changed, and wherein when the nip pressure of the nip part is changed from a low-pressure state to a high-pressure state, the adjusting section moves or deforms the pressing member before the nip pressure is changed.

6. An image forming apparatus comprising:

an image forming unit that forms an image on a recording material;

an endless belt member that is rotatably provided and that has a curved portion;

a pressure member that is provided at an outer peripheral surface of the belt member so as to contact the outer peripheral surface of the belt member, the pressure member applying pressure to the belt member;

a pressing member that presses the belt member from an inner side of the belt member towards the pressure member; and an adjusting section that adjusts a position of an end portion of a nip part at a downstream side in a movement direction of the recording material and a position of the curved portion of the belt member by moving or deforming the pressing member, the nip part being formed by the belt member and the pressure member, the curved portion of the belt member being formed by an end portion of the pressing member at a downstream side in the movement direction of the recording material, wherein the adjusting section adjusts by moving the pressing member towards an upstream side or the downstream side in the movement direction of the recording material, wherein the position of the curved portion of the belt member is located further downstream, in a movement direction of the recording material, than the position of the end portion of the nip part when the adjusting section adjusts by moving the pressing member towards the downstream side in the movement direction of the recording material, and wherein the adjusting section adjusts the position of the pressing member without rotating the pressing member.

7. The image forming apparatus according to claim 6, wherein the adjusting section is provided inside of the belt member.

* * * * *